United States Patent [19]

Dutt

[11] Patent Number: 4,640,435

[45] Date of Patent: Feb. 3, 1987

[54] PLASTIC CLOSURE FOR BEVERAGE CONTAINER

[75] Inventor: Herbert V. Dutt, Sarasota, Fla.

[73] Assignee: Sun Coast Plastics, Inc., Sarasota, Fla.

[21] Appl. No.: 824,983

[22] Filed: Jan. 23, 1986

[51] Int. Cl.[4] ..... B65D 39/00

[52] U.S. Cl. ..... 220/307; 220/306; 150/55

[58] Field of Search ..... 220/306, 307; 215/1 C, 215/316; 150/55

[56] References Cited

U.S. PATENT DOCUMENTS

| | | | |
|---|---|---|---|
| 3,144,167 | 7/1961 | Schultz . | |
| 3,297,193 | 1/1967 | Stevens, Jr. . | |
| 3,307,602 | 3/1967 | Boster . | |
| 3,315,872 | 4/1967 | Carbone . | |
| 3,320,993 | 5/1967 | Motsenbocker . | |
| 3,322,299 | 5/1967 | Foster . | |
| 3,415,404 | 12/1968 | Robinson . | |
| 3,556,338 | 1/1971 | Wilkinson et al. . | |
| 3,892,351 | 7/1975 | Johnson et al. . | |
| 3,981,412 | 9/1976 | Asmus . | |
| 4,024,976 | 5/1977 | Acton . | |
| 4,030,630 | 6/1977 | Yealy . | |
| 4,281,774 | 8/1981 | Mumford . | |
| 4,349,119 | 9/1982 | Letica | 220/307 |
| 4,376,493 | 3/1983 | Gall | 220/306 |
| 4,444,332 | 4/1984 | Widen et al. | 220/306 |
| 4,466,553 | 8/1984 | Zenger . | |

FOREIGN PATENT DOCUMENTS

| | | |
|---|---|---|
| 2408531 | 6/1979 | France . |
| 866652 | 2/1960 | United Kingdom . |
| 1160083 | 7/1969 | United Kingdom . |

*Primary Examiner*—George T. Hall

*Attorney, Agent, or Firm*—Jones, Tullar & Cooper

[57] ABSTRACT

A container for carbonated beverages is disclosed. The container includes an interlocking plastic lid and plastic can construction wherein the lid snaps onto the can to provide a sealed container capable of withstanding high internal pressure without leakage.

The can includes a neck portion having an inwardly extending ridge and an outwardly flared mouth thereabove. An outwardly and downwardly extending locking flange is unitarily formed at the top of the can mouth. The lid includes a concave top wall which fits into the can mouth and engages the ridge, and a peripheral rim which includes a downwardly opening groove to receive the locking flange. The lid is rigid, and is shaped to compress the locking flange as the lid is pressed onto the can, with the locking flange snapping outwardly over an annular shoulder to secure the lid in place. The flange is held in compression by the groove to insure an intimate surface-to-surface seal around the circumference of the can, the rigid lid providing sufficient hoop strength to maintain the shape of the container, even under high internal pressures.

15 Claims, 5 Drawing Figures

PLASTIC CLOSURE FOR BEVERAGE CONTAINER

BACKGROUND OF THE INVENTION

The present invention relates, in general, to containers for beverages and, more particularly, to plastic closures for wide-mouthed plastic cans particularly suitable for packaging liquids such as carbonated beverages.

Metal cans have long been in use for packaging soft drinks and like carbonated beverages, and have satisfactorily met the needs of the beverage industry. However, the introduction of so-called "plastic cans" is being considered by the soft drink industry for a variety of reasons, including the fact that such containers enjoy some cost advantage over metal cans. One of the problems faced in the production of plastic cans is the difficulty encountered in securing a suitable closure that is easy to make and easy to install, and which will be secure enough to withstand the internal pressures generated by carbonated beverages when sealed in containers.

A "plastic can" may take a variety of shapes, and may be of any desired size, but, generally, is a cylindrical container capable of holding about 12 fluid ounces, and is formed of a plastic material such as polypropylene, polyvinyl chloride (PVC), polyethylene terephthalate (PET), or the like, with PET being the preferred material. Such a material has the strength required to withstand the pressures, of up to about 150 psi, which can be generated by a carbonated beverage, limits the permeation or leakage of carbon dioxide so that beverages will have a long shelf life, and does not require the internal coating which is needed by a metal container to avoid adversely affecting the taste of the contents. Such a plastic container is transparent, and has the consequent marketing advantage of enabling customers to see what they are buying. Further, such a container has good thermal insulating qualities, so that the container does not feel as cold to the touch as does a metal container when the contents are chilled. A container of this type is closed at the bottom by a concave, spherical bottom wall to provide the required strength characteristics, and has a wide mouth at the top, preferably extending across substantially the entire diameter of the container, which must be closed after the container is filled. The present invention provides a plastic closure for such containers.

It has been proposed to close the mouth of a plastic can with a metal lid, preferably aluminum, which is similar to the lids commonly used on metal beverage cans. Such lids have been applied to the upper edges of the plastic cans by a crimping process, and although this process has been found to be workable, it is not without problems. First, the crimping of such lids onto the container involves a multi-step process which includes the application of a sealant material between the lid and the container, the application of the lid, and a crimping operation. These multiple manufacturing steps are expensive and time-consuming, and thus the use of a metal lid is not entirely satisfactory. Furthermore, the combination of a metal lid with a plastic closure is deemed by many to be aesthetically unappealing, and thus does not have the marketability that is anticipated for an all-plastic container and lid combination. In addition, a metal lid on a plastic can significantly increases the cost of recycling the container, for the lid must be removed from the can so that the two materials can be separately handled in the recycling process. Since the recycling of the materials has become an important factor in the manufacturing and marketing of containers, provision of a container and closure formed of a single material is highly desirable. However, no completely satisfactory plastic closure has yet been devised for plastic cans which would provide easy installation, secure sealing of the container, and the ability to withstand high pressures for a long shelf life. In particular, no previous design has been found that will allow a snap-on fit between a plastic can and its plastic lid, which will not require additional sealing materials between the can and the lid, and which will allow the use of the same materials for both components for facilitating recycling of the materials.

Thus, there is a significant need for a plastic lid, or closure, for a wide-mouthed plastic beverage can which will overcome the various problems encountered with the use of metal lids on plastic cans, as outlined above, including allowing the entire container to be recycled without the need for a prior separation of the two components. A plastic lid for a plastic can would reduce the cost of such containers, particularly if a simplified procedure for securing the lid to the can could be found which would eliminate the steps of crimping and sealing which are now used. Further, such a lid would complement the appearance of the plastic container, and would, therefore, result in a more marketable product.

SUMMARY OF THE INVENTION

It is, therefore, an object of the present invention to produce a plastic lid, or closure, for a plastic can.

A further object of the invention is to provide a plastic container design which enables a plastic lid to be secured on a plastic can in a simple and economical manner.

It is still another object of the present invention to provide a plastic closure for a plastic can wherein the closure is applied by a snap-on operation to eliminate previously required crimping and sealing operations, and which will withstand the high pressure that can be generated by carbonated beverages.

A still further object of the present invention is to produce a plastic can having a peripheral locking flange which will engage a corresponding peripheral groove in a plastic lid to enable the lid to be secured to the top edge of the can with a snap-on fit for quick assembly, and which will provide, at the same time, a reliable high-pressure seal.

Another object of the invention is to produce a plastic can having a locking flange forming a joint between the lid and the upper peripheral rim of the can to facilitate assembly and to provide an effective seal against leakage.

Another object of the present invention is to provide a plastic snap-on lid for a wide-mouthed plastic container which will withstand high pressure and which will provide a seal against leakage.

Briefly, the present invention includes a plastic container having a lid portion and a body portion in the form of a can. The can is formed with a thin, transparent, cylindrical side wall, and with a domed, or spherical, concave, unitary bottom wall. The top of the container is open to provide a wide-mouthed neck portion. The mouth of the container is flared slightly outwardly, and at its top edge can is curved outwardly and downwardly to form an inverted V shape in cross section, with the free end of the curved portion forming a locking flange which extends continuously around the outer periphery of the container. The top edge of the can, at the start of the curved flange, lies in a horizontal plane which is perpendicular to the vertical axis of the side wall of the container, and the locking flange extends radially outwardly and downwardly at an angle of about 60 to 70 degrees from that plane.

The invention further incudes a plastic closure, or lid, which is formed, as by injection molding, to provide a transparent, dome-shaped, or spherical, concave top wall for the plastic can when the lid and can are assembled to form a container. The lid includes a peripheral, upstanding rim which is curved outwardly and downwardly to define a downwardly facing locking groove adapted to snap over the peripheral top edge of the container side wall and to engage the locking flange for quick assembly of the can and lid. The locking groove is, in cross section, generally in the shape of an inverted V, having an inner wall which engages the interior surface of the mouth of the can, a curved top portion which engages the top edge of the can, and an outer wall extending downwardly to engage the flared locking flange of the can. When assembled, the locking groove receives the entire top edge of the can, with the groove and the locking flange of the can cooperating to form an interlocking joint between the two components of the container.

The outer wall of the locking groove is formed at an angle of about 75 degrees below the plane of the container mouth when the lid is assembled thereto. The outer wall of the groove also includes an inwardly projecting annular shoulder which receives the free end of the locking flange when the lid tightly engages the can. The flange is sufficiently flexible to allow it to bend inwardly so that the outer wall and the shoulder of the lid groove will pass over the flange, the flange returning toward its initial angle after the shoulder passes over the free edge of the flange, thereby causing the edge of the flange to engage the wall of the groove above the shoulder in a "snap-on" operation, and preventing removal of the lid. The locking flange and the lid groove are so dimensioned as to produce an inward flexing of the flange of about 15 degrees between the open position, before application of the lid, and the closed position, when the lid is fully engaged. Thus, the flange initially extends at an angle of about 60 degrees below the horizontal plane of the mouth of the container, is flexed radially inwardly to allow the lid to pass over it, and snaps outwardly over the shoulder portion to the closed, or sealing, position, where the flange forms an angle of about 75 degrees below the horizontal plane. With the lid in its engaged position, the locking flange, which tends to return to its initial position, is urged outwardly against the outer wall portion of the groove, and thereby also tends to press the flared side wall at the mouth of the can against the inner wall of the groove to produce a firm locking and sealing operation, not only at the peripheral free edge of the flange, where it meets the shoulder in a line contact, but along the entire contacting surfaces of the flange, the mouth of the can, and the lid groove.

Just below the V-shaped groove on the rim of the container lid, and formed integrally with the inner wall of the groove, is an outwardly projecting annular bead which engages a corresponding inwardly curved portion of the side wall of the container. The inwardly curved side wall portion forms an outwardly projecting annular ridge around the interior of the container, the ridge being engaged by the annular bead to help secure the lid on the container and to insure full engagement between the can and the lid.

The lid is formed from the same plastic material as the container, and preferably is PET. The domed shape of the lid, the rim and its inverted V-shaped peripheral groove around the outer edge of the lid, and the annular bead formed on the rim of the lid just below the groove, all cooperate to provide a rigid construction having substantial hoop strength to insure that the container will retain its shape during use, even under high internal pressure, or during shipping and handling of the filled container, so that once the lid is placed on the container, the joint between the lid and the container will retain its integrity, and the container will remain sealed. Because of the stiffness of the lid, it can be easily and rapidly placed on a can by a simple downward pressure to bring the groove into full contact and engagement with the locking flange formed on the can and will be secured thereon by a snap action which produces a high-quality seal, which actually improves as the internal pressure increases.

In assembly of the container, the bottom edge of the outer wall of the lid groove is pressed downwardly on the top of the locking flange, causing the free edge of the locking flange to flex inwardly without stretching the outer peripheral edge of the lid. At the same time, the annular bead on the inner wall of the groove engages the interior surface of the can wall, stretching the can radially outwardly a slight amount as the lid is pressed down. When the top edge of the container rim fully engages the groove, the free edge of the locking flange snaps over the annular shoulder formed in the groove, and, at the same time, the annular bead snaps over the curved ridge on the container wall. This produces an intimate, continuous, surface-to-surface sealing engagement of the can with the lid from the outer free end of the locking flange to the annular ridge. In addition, assembly of the lid onto the can produces a line sealing contact between the free edge of the locking flange and the inner surface of the groove above the annular shoulder.

The inward flexing of the flange from its normal 60 to 70 degree angle to a 75 degree angle below the horizontal causes the free edge of the flange to press against the interior of the groove for sealing. The hoop strength of the lid insures that this sealing contact is maintained even during shipping and handling of the container. Because, in the preferred form of the invention, similar plastic materials are used for both the lid and the container side wall, a high-quality seal is provided when these materials are brought into close engagement by the snap-on assembly process described above, and this seal is maintained by the hoop strength of the lid. It has also been found that the dome shape of the lid not only provides structural strength to the lid, but the shape also reacts to internal pressures generated within the container, as by a carbonated beverage, the pressure causing outward flexing of the lid which tends to spread the dome radially outwardly to thereby produce an outward pressure in the region of the annular bead. This presses the annular bead more tightly against the inside surface of the wall of the container to produce an improved seal therebetween. Thus, with increased pressure within the container, the seal between the lid and the container actually improves, so that the higher the pressure, the better the seal.

The interlocking structure of the plastic lid and plastic can of the present invention not only facilitates the sealing and closing of containers by providing a simple snap-on assembly, but also provides an improved seal which is capable of withstanding high internal pressures, and of maintaining its shape during handling of filled containers so as to maintain the integrity of the seal and thus to preserve the contents of the container. In addition, the improved device also simplifies recycling of the plastic container by eliminating the need for separation of a metal lid so that the entire device can be recycled simply by grinding the container and lid assembly. Thus, the present invention overcomes the various problems encountered with prior art devices, as outlined above.

BRIEF DESCRIPTION OF THE DRAWINGS

The foregoing and additional objects, features, and advantages of the present invention will become apparent to those of skill in the art from a consideration of the following detailed description of a preferred embodiment, taken in conjunction with the accompanying drawings, in which.

DESCRIPTION OF PREFERRED EMBODIMENT

Figure 3:
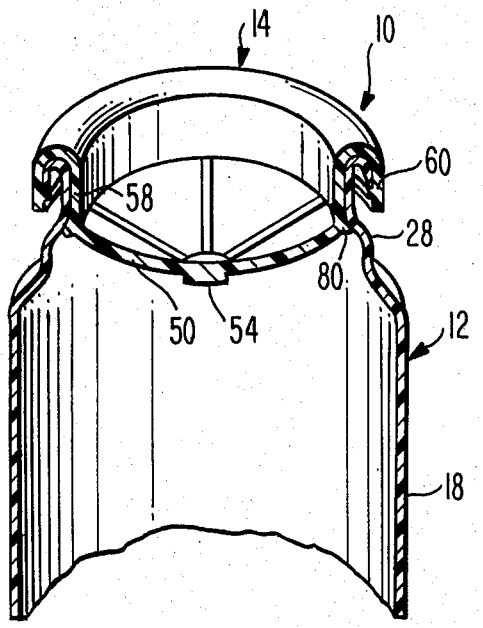
FIG. 3 is a cross-sectional perspective view of the device of FIG. 1, again taken along lines 2—2 of FIG. 1.
Figure 1:
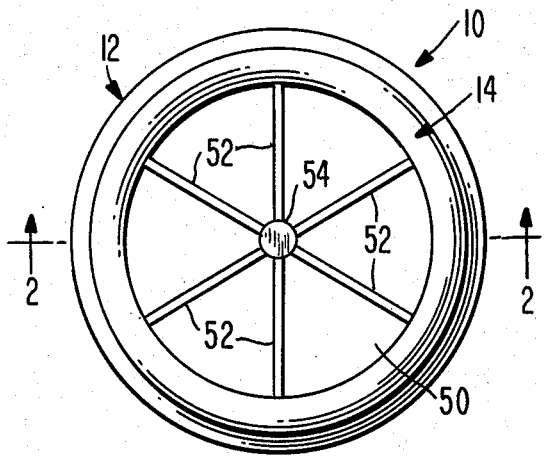
FIG. 1 is a top plan view of a container incorporating the container and lid assembly of the present invention.
Figure 2:
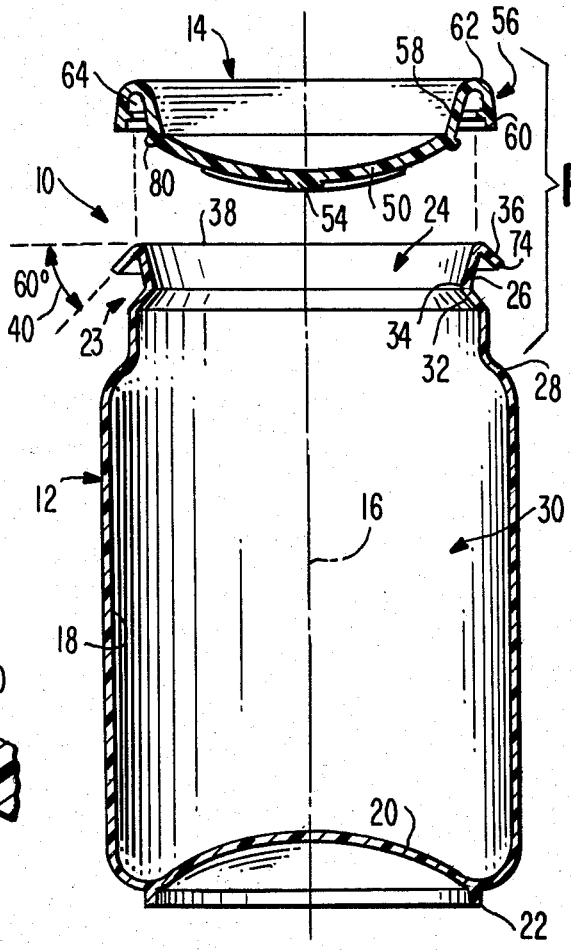
FIG. 2 is a cross-sectional view of the device of FIG. 1, taken along lines 2—2.

Turning now to a more detailed consideration of the present invention, there is generally illustrated at 10 in FIGS. 1, 2, and 3 a plastic container which includes a plastic can 12 and a cooperating plastic lid, or closure, 14, which is shaped to fit over and firmly engage the top edge of can 12. The plastic can may take a variety of shapes, but preferably is generally cylindrical, with a vertical axis 16, and a cylindrical side wall 18. The can is constructed of PET and may be formed in a conventional manner, as by an extrusion process, or by the method of forming described in U.S. Pat. No. 4,405,546. The can may have a nominal diameter of about $2\frac{3}{8}''$ and a height of about five inches, with a wall thickness of about 0.007 inch, in one form of the invention. The bottom of the container is closed by a unitary bottom wall 20 which is in a spherical shape to form a concave dome. A stacking ring 22 is formed on the exterior of the can 12 at the juncture between the side wall 18 and the bottom wall 20.

In accordance with the preferred form of the invention, the upper end of the can includes a neck portion 23 formed with a tapered mouth 24 which includes an outwardly flared neck segment 26 which is unitarily formed with the side wall 18. The neck portion 23 of the side wall may be shaped in a variety of ways, but as shown, is sloped inwardly at 28 from the main cylindrical body portion 30 of the can and is further tapered inwardly at 32 to meet with the bottom of the neck segment 26 to form an inwardly extending ridge 34. The ridge 34 and the neck segment 26 form the mouth 24 of the can.

Integrally formed with the top of neck segment 26 is an outwardly and downwardly extending locking flange 36 which meets the neck segment 26 at a top edge 38 of the can. Top edge 38 lies in a plane which is perpendicular to the axis 16 of the container, and the flange 36 is angled downwardly from that plane by an angle 40 which may be about 60 degrees, and preferably is between 60 and 70 degrees. The flange 36 is of approximately the same thickness as the side wall 18, and thus is relatively flexible so that the flange may be folded downwardly and inwardly upon application of the lid 14, as will be explained below, but is sufficiently resilient to tend to return to the angle 40 so that a continuous, outward pressure is exerted by the flange against the lid 14 when the container is assembled.

Figure 4:
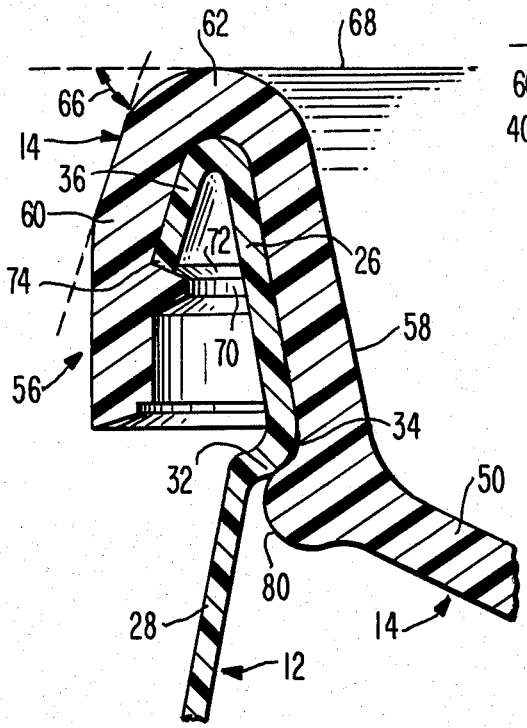
FIG. 4 is an enlarged view of the joint between the lid portion and the plastic can portion of the container of FIG. 3.
Figure 5:
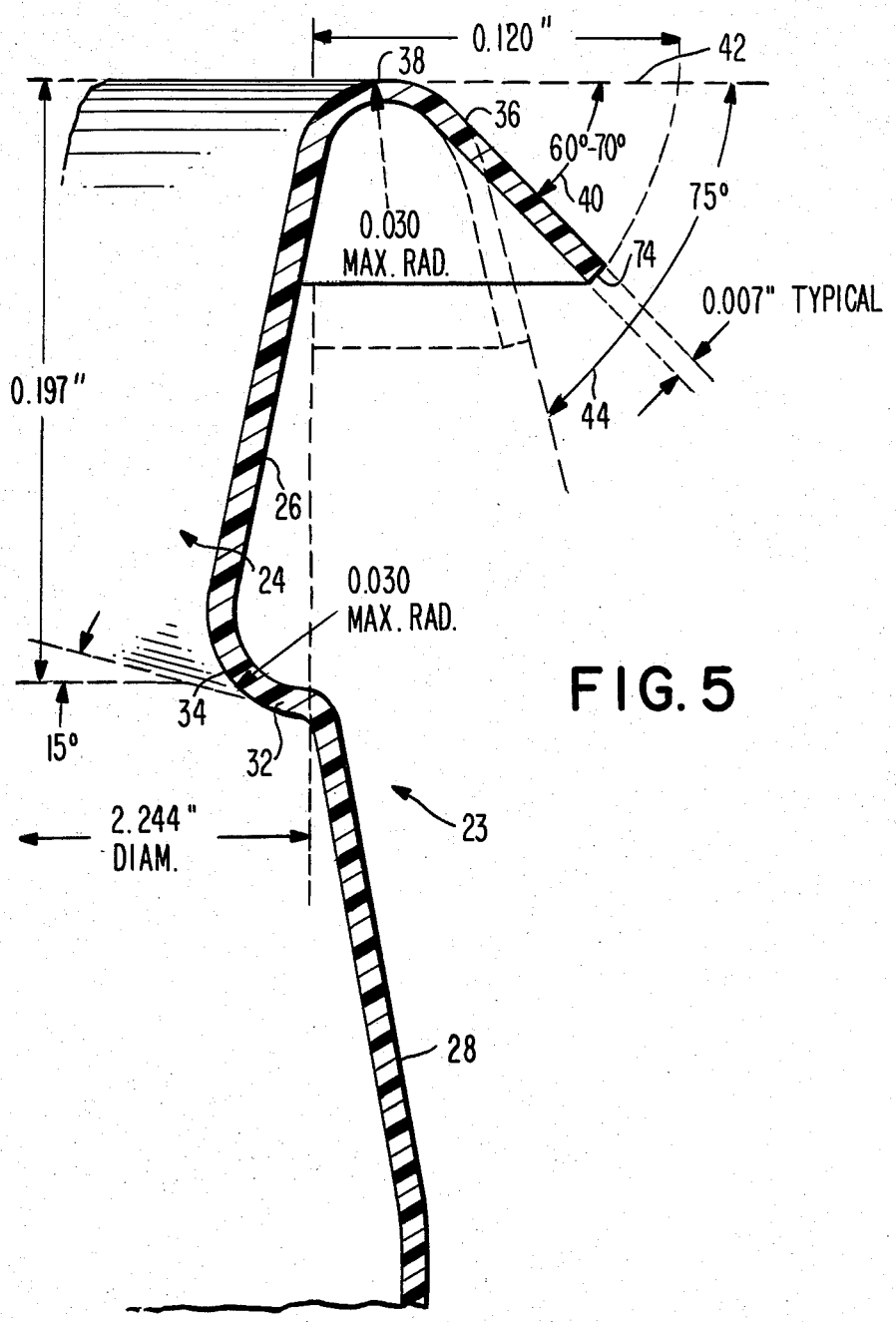
FIG. 5 is an enlarged sectional view of the neck portion of the plastic can of FIG. 2.

The construction of the neck and mouth portions of the container is more clearly illustrated in the enlarged views of FIGS. 4 and 5, which show a typical construction. Thus, the neck portion 23 of the side wall 18 tapers inwardly at 28 and at portion 32 to form the inwardly extending ridge 34 and then flares outwardly at 26 to form the mouth 24 of the can. The flange 36 extends outwardly from the neck segment 26 and is curved to form the top edge 38 of the can. As shown, the flange 36 in cross section forms an inverted V shape with the neck segment 26, is initially at an angle of approximately 60 degrees from the horizontal plane 42 defined by the top edge 38, and is capable of flexing inwardly an additional amount to accommodate the lid. The lid captures the flange and flexes it an added 15 degrees, as shown by the angle 44.

The lid portion 14 for the container 10 is illustrated in cross section in FIGS. 2, 3, and 4, and is shaped to fit into the mouth 24 of the can 12 and to snap over the flange 36 to provide a secure, leak-proof seal for the can. The lid is of a plastic material, preferably of the same material as the can 12, and thus preferably of PET. The construction of the lid is such that it is relatively rigid with respect to the can, and this is accomplished by its shape, and by making it two to three times as thick as the can wall. The lid is formed in a conventional manner, as by injection molding, to include a concave top wall 50 which is of a diameter to span the mouth 24 of the can 12, and thus to form a closure for the can when the lid is in place. The top wall is generally spherical in shape to provide sufficient strength to resist internal pressures generated within the container by contents such as carbonated beverages. The top wall 50 is reinforced by a plurality of ribs 52 formed on its bottom surface and radiating from a central hub 54.

Formed integrally with the top wall 50 is a peripheral, upstanding rim generally indicated at 56, the rim including an inner wall 58, an outer wall 60, and a bridging wall 62 which cooperate to form a downwardly facing groove 64 which is generally V-shaped in cross section, and is shaped to receive the flared neck segment 26 and the flange 36 of can 12. The inner wall 58 is flared outwardly at the same angle as the neck segment 26 of the can so that the outer surface of wall 58 and the inner surface of segment 26 engage continuously along the entire vertical length of segment 26 and continuously around the circumference of the mouth portion 24 when the lid is fully engaged with the can, as illustrated in FIGS. 3 and 4. The outer wall 60 of the rim portion 56 is angled downwardly at an angle about 15 degrees more than the angle of flange 36 from the horizontal;

accordingly, rim portion 60 is at angle 66 below the horizontal plane defined by the top edge 68 of the lid when the lid is positioned on the can 12. This angle 66 is at about 75 degrees in the area of the rim which forms the flange-receiving groove 64.

The rim portion 56 also includes an annular shoulder 70 which extends around the inner circumference of outer wall 60. This shoulder provides an upper ledge 72 which receives the lower, free edge 74 of flange 36 when the lid is fully engaged in the mouth portion of the can 12. Shoulder 70 and flange 36 cooperate to provide the "snap-on" operation of the lid which will be described in further detail below.

The lid 14 also includes an annular bead 80 which extends circumferentially around the top wall portion 50 at the junction of the top wall with the rim 56. The bead is on the exterior surface of the inner wall portion 58 of the rim, and is located to engage the lower edge of ridge 34 formed in the neck portion of can 12, as most clearly seen in FIG. 4. Bead 80 is so located as to assist in the snap-on operation of the lid, to insure proper seating of the lid on the can, and to provide an improved sealing operation when the container is subjected to internal pressure.

After the can 12 is filled, the lid 14 can be placed on the can in a single operation to close and seal the container. This is accomplished simply by pressing the lid downwardly so that the top wall portion 50 enters the mouth of the can with the bead 80 sliding down the interior surface of the wall portion 26, and with the flange portion 36 and the top edge 38 entering the downwardly facing groove 64 of the lid. Pressure on the lid causes the side wall of the can to expand in the region of the neck 23 to allow the bead 80 to pass downwardly over ridge 34 and to snap into place below the ridge. At the same time, the flange 36 is flexed inwardly, as indicated in FIG. 5, from its initial angle 40 by the pressure of the outer wall 60 and the shoulder 70 of groove 64. Because of the construction and thickness of the lid, the lid is rigid as compared to the can 12, so that the side wall of the can is flexed slightly outwardly by the bead 80 to accommodate its passage over ridge 34 while at the same time the flange 36 is compressed inwardly to accommodate the passage of the free end of the flange over shoulder 70. As the lid seats on the mouth of the can 12, bead 80 snaps over ridge 34 and the free end of the flange 36 passes over the shoulder 70, allowing the flange to spring outwardly to the position illustrated in FIG. 4, which is at about the angle 44 illustrated in FIG. 5, where the bottom edge 74 of the flange rests on the top ledge 72 of shoulder 70. The ridge 34 and the shoulder 70 thus hold the lid securely onto the can, the resilience of the flange 36 causing it to press outwardly against the outer wall 60 of the rim 56 to prevent removal of the lid. The lid thus holds flange 36 in a compressed position, forcing the interior surfaces of the groove 64 into close contact with the exterior surfaces of the flange 36 and the interior surface of neck segment 26, so as to insure a continuous surface-to-surface contact throughout the cross-sectional length of the groove as well as around its periphery, to thereby insure the integrity of the seal between the lid and the can. In addition, the edge 74 of the flange presses outwardly against the wall 60 and the upper surface 72 of shoulder 70 to produce a line of contact which provides an added seal.

It will be noted that the concave shape of the top wall 50 of the lid responds to any increase in pressure within the can 12 by tending to flex upwardly. Such a flexing motion tends to spread the bead 80 and the wall portion 58 radially outwardly against the inner surface of the can to thereby improve the seal between the lid and the can, rather than allowing leakage. Thus, the bead 80, the shoulder 70, the outwardly flared neck segment 26, and the flange 36 cooperate to lock the lid in place once it has been snapped on, thereby providing a high-quality seal. The hoop strength of the lid maintains the shape of the can and insures that the surface-to-surface contact is maintained continuously around the periphery. Furthermore, it has been found that the use of PET or similar compatible resins for the plastic material of both the lid and the can provides the required surface-to-surface sealing effect, without the use of adhesives or other sealing materials. All that is required is an intimate, continuous contact between the two surfaces to maintain a seal which will withstand the pressures generated within a soft drink or other carbonated beverage can. Furthermore, since both the lid and the can are made of the same material, any temperature changes will affect both components of the container in the same way so that there is no problem with temperature creep between the materials. The smooth, compatible surfaces of the lid and can due to the use of a material such as PET for both causes the materials to tend to stick together, and the forced intimate contact created by pressing the lid onto the container so as to compress the flange and hold it in compression creates a high-quality seal.

Thus, there has been provided a new and improved plastic container for liquids such as carbonated beverages, which overcomes the difficulties of the prior art, and produces an aesthetically pleasing container at a lower cost, and which presents fewer problems in recycling. Although the present invention has been described in terms of a preferred embodiment, it will be apparent that numerous changes and modifications can be made without departing from the true spirit and scope thereof, as set forth in the following claims.

What is claimed is:

1. A plastic lid for a wide-mouthed plastic container wherein the container includes a side wall having at its upper peripheral edge a radially outwardly and downwardly flared locking flange terminating in a free flange edge, said lid comprising:

a top wall having a peripheral rim extending generally upwardly, outwardly, and then downwardly from said top wall to define a V-shaped peripheral groove having inner, upper, and outer walls receiving the locking flange of a container;

an annular shoulder integrally formed within said peripheral groove on the outer wall thereof for engaging the free edge of the locking flange of a container; and an annular bead extending outwardly from the inner wall of said peripheral rim for engaging the interior surface of the side wall of a container below the locking flange thereof, said lid being shaped to extend into the mouth of a container with said groove engaging the locking flange in a snap-on fit to produce a surface-to-surface sealing engagement between the container and said lid.

2. The plastic lid of claim 1, wherein said top wall is dome-shaped and is curved in a direction to extend downwardly into a container when said lid is applied to the container.

3. The plastic lid of claim 1 wherein said top wall and peripheral rim are sufficiently rigid to remain essentially undeformed when said lid is applied to a container to close and seal the container.

4. The plastic lid of claim 3, wherein said outer wall of said peripheral groove is angled to deform the locking flange of a container when the lid is applied thereto, whereby a line seal is formed between the locking flange and the lid.

5. The plastic lid of claim 4, wherein said top wall is dome-shaped to extend downwardly into a container when said lid is applied to the container.

6. The plastic lid of claim 5, wherein the peripheral edge of said lid describes a circle.

7. The plastic lid of claim 3, wherein the width of said groove is substantially less than the width of the locking flange of a container to deform the locking flange when the lid is applied thereto, said lid remaining essentially undeformed.

8. The plastic lid of claim 7, wherein said plastic lid has a hoop strength sufficient to prevent deformation of a container to which it is applied, thereby to maintain the integrity of the surface-to-surface sealing engagement therebetween when the container is subjected to high internal pressures.

9. A fluid-tight junction for joining a plastic lid and a plastic container, comprising:

a plastic container having a generally cylindrical side wall, said side wall including an inner ridge;

an outwardly extending locking flange formed at the top of said container side wall above said ridge, said flange having a peripheral free edge, and extending at a first angle;

a plastic lid having a concave top wall and an upwardly extending peripheral rim, said peripheral rim including a downwardly opening groove receiving said locking flange, said groove having an outer wall extending at a second angle which is greater than said first angle, whereby said locking flange is flexed radially inwardly by said groove;

an annular shoulder within said groove and receiving said free edge of said flange;

an outwardly extending annular bead on said peripheral rim engaging said inner ridge; and said locking flange engaging said groove in substantially continuous surface-to-surface contact from said annular shoulder to said annular bead, with said annular shoulder and said inner ridge of said lid engaging said peripheral free edge and said inner ridge, respectively, of said container in a snap fit to provide a fluid-tight seal between said lid and said container.

10. The fluid-tight junction of claim 9, wherein said locking flange extends outwardly and downwardly at an angle of about 60 degrees below horizontal when free of said lid, and wherein said lid flexes said flange downwardly for insertion of said flange into said groove, whereby said groove maintains said flange in radial compression to insure engagement of the free edge of the flange with said annular shoulder, to press the surface of said flange against the surface of said groove, and to prevent removal of said lid from said container.

11. The fluid-tight junction of claim 10, wherein said container and said lid are made from the same plastic material.

12. A plastic container including a plastic lid for sealingly closing the mouth of a plastic can, comprising:

a plastic can having a generally cylindrical side wall, a closed bottom, and an open, outwardly flared mouth, said mouth being defined by the upper peripheral edge of said side wall;

an outwardly extending locking flange at the top of said wall, said flange having a free end and extending at an angle of about 60 to 70 degrees downwardly from a plane passing through said upper peripheral edge of said side wall;

a rigid plastic lid having a spherical, concave top wall and a peripheral, upwardly extending rim, said rim having an inner wall which is flared outwardly to match the flare of said open mouth and to provide surface-to-surface contact therewith when said lid is in position to close the mouth of said container, an outer wall, and a bridging wall between said inner and outer walls to define a U-shaped, downwardly facing groove, said outer wall forming an angle of about 75 degrees downwardly from said plane when said lid and can are assembled;

an annular shoulder formed on said rim outer wall;

said flange being received in said groove and being compressed between said inner and outer walls with said free end of said flange engaging said annular shoulder when said lid and can are assembled, thereby providing an intimate, continuous, surface-to-surface contact between said lid and said can over the entire surface of said groove above said annular shoulder.

13. The container of claim 12, wherein said lid and said can are formed from PET, to provide a leakage-free seal.

14. The container of claim 12, wherein said lid is sufficiently rigid to compress said flange without deformation of said lid rim.

15. The container of claim 13, further including an outwardly extending annular bead formed on the inner wall of said rim, and a corresponding outwardly extending annular ridge formed on said side wall to receive said annular bead when said lid is assembled with said can.

* * * * *